US008043005B2

(12) United States Patent
Lyon et al.

(10) Patent No.: US 8,043,005 B2
(45) Date of Patent: Oct. 25, 2011

(54) RESERVOIR CLOSURE SYSTEM AND METHOD

(75) Inventors: Matthew J. Lyon, Moraga, CA (US); Samuel M. Lopez, San Francisco, CA (US)

(73) Assignee: Hydrapak, Inc., Oakland, CA (US)

( * ) Notice: Subject to any disclaimer, the term of this patent is extended or adjusted under 35 U.S.C. 154(b) by 1082 days.

(21) Appl. No.: 11/445,721

(22) Filed: Jun. 2, 2006

(65) Prior Publication Data

US 2007/0280564 A1 Dec. 6, 2007

(51) Int. Cl.
*B65D 33/16* (2006.01)
*A22C 15/00* (2006.01)
*A43C 11/12* (2006.01)

(52) U.S. Cl. ..... 383/69; 24/30.5 L; 24/437

(58) Field of Classification Search ..... 383/61.1, 383/61.2, 62, 68, 69, 78, 127, 64; 224/148.1, 224/148.2, 148.3, 148.4; 24/30.5 L, 437, 24/545, 546

See application file for complete search history.

(56) References Cited

U.S. PATENT DOCUMENTS

| | | | | | |
|---|---|---|---|---|---|
| 1,371,934 | A | * | 3/1921 | Reynolds | 383/69 |
| 1,781,448 | A | | 11/1930 | Dunnican | |
| 2,064,432 | A | * | 12/1936 | Keidel | 383/69 |
| 2,500,363 | A | * | 3/1950 | Koeppel | 383/59 |
| 2,514,750 | A | | 7/1950 | Dobbs et al. | |
| 3,026,017 | A | | 3/1962 | Hopkins | |
| 3,173,184 | A | | 3/1965 | Ausnit | |
| 3,381,883 | A | * | 5/1968 | Harris | 229/125.19 |
| 3,437,117 | A | * | 4/1969 | Vitello et al. | 383/69 |
| 3,738,790 | A | * | 6/1973 | Violette et al. | 425/467 |
| 4,099,656 | A | * | 7/1978 | Neumann et al. | 294/157 |
| 4,541,117 | A | * | 9/1985 | Ashbeck | 383/69 |
| 4,660,259 | A | | 4/1987 | Ausnit | |
| 4,883,329 | A | | 11/1989 | Flannery et al. | |
| 4,979,663 | A | | 12/1990 | Sofia et al. | |
| 4,979,668 | A | * | 12/1990 | Allen et al. | 383/69 |
| 5,116,139 | A | | 5/1992 | Young et al. | |
| 5,211,482 | A | | 5/1993 | Tilman | |
| 5,354,132 | A | | 10/1994 | Young et al. | |
| 5,435,648 | A | * | 7/1995 | Berkoff | 383/90 |
| 5,462,222 | A | * | 10/1995 | Boeck, II | 383/69 |
| 5,765,264 | A | * | 6/1998 | Ciok | 383/69 |
| 5,947,524 | A | * | 9/1999 | Podosek | 281/45 |
| 6,059,456 | A | | 5/2000 | May | |
| 6,074,094 | A | * | 6/2000 | Manolizi et al. | 383/5 |
| 6,199,256 | B1 | | 3/2001 | Revnew et al. | |
| 6,200,027 | B1 | | 3/2001 | Jones | |
| 6,267,506 | B1 | * | 7/2001 | Campion | 383/61.1 |
| 6,464,394 | B1 | * | 10/2002 | Galomb | 383/10 |
| 6,584,666 | B1 | | 7/2003 | Savicki | |
| 6,622,353 | B2 | | 9/2003 | Provan et al. | |

(Continued)

FOREIGN PATENT DOCUMENTS

| | | |
|---|---|---|
| FR | 74516 E | 12/1960 |

(Continued)

*Primary Examiner* — Jes F Pascua

(74) *Attorney, Agent, or Firm* — Levine Bagade Han LLP

(57) ABSTRACT

A system for sealably closing a reservoir is disclosed. The system can have a container and a slider. The container can have an orifice and catches and lips surrounding the orifice. The slider can be translatably attached to the container over the orifice. The slider can slidably engage the catch and lips to force the orifice closed. While attached to the catch and lips, the slider can create a pressurized seal of the orifice.

14 Claims, 15 Drawing Sheets

U.S. PATENT DOCUMENTS

| | | | | |
|---|---|---|---|---|
| 6,836,945 | B2 | 1/2005 | Savicki | |
| 6,846,544 | B2 | 1/2005 | Buchman | |
| 6,960,021 | B2 | 11/2005 | Schneider et al. | |
| 2002/0094140 | A1* | 7/2002 | Gill | 383/68 |
| 2002/0154835 | A1 | 10/2002 | Galomb | |
| 2003/0210837 | A1 | 11/2003 | Wedi et al. | |
| 2004/0055254 | A1* | 3/2004 | Setton | 53/410 |
| 2004/0066990 | A1 | 4/2004 | Schneider et al. | |
| 2004/0081375 | A1 | 4/2004 | Pokusa | |
| 2004/0198944 | A1* | 10/2004 | Meltzer et al. | 528/80 |
| 2005/0123218 | A1 | 6/2005 | Pokusa | |

FOREIGN PATENT DOCUMENTS

| | | | |
|---|---|---|---|
| GB | 2266701 | A | 11/1993 |
| IT | 0544362 | | 6/1956 |
| IT | 0597773 | | 9/1959 |

* cited by examiner

RESERVOIR CLOSURE SYSTEM AND METHOD

BACKGROUND OF THE INVENTION

1. Field of the Invention

This invention relates to the field of closeable and sealable fluid reservoirs. More specifically, this invention relates to reservoirs that can be closed and tightly and securely sealed, yet unsealed and opened rapidly.

2. Description of the Related Art

Light weight, resealable bags are used increasingly in sporting activities, such as hiking, biking, and snow sport activities like skiing and snowboarding. Limited access to the interior of typical bags makes cleaning more difficult and increases the potential for unclean and unsanitary bags. Once liquids placed in the bags are consumed, the remaining deposits encourage the growth of bacteria and mold. If left uncleaned, such growths can leave stains on the bag, may retain odors, taint any other fluids subsequently introduced into the bag, and create health risks. Regular and thorough cleaning of the inside of the reservoir is critical.

Commonly used bags for sporting are typically accessible through a relatively small side port in the bag, often covered by a removable cap. The side port limits the access to the interior of the bag, thereby limiting the ability to clean the interior of the bag.

Also, removing or adding large quantities of liquid to the typical bags is often cumbersome and messy due to the limited and constrained access to reservoir via the side port. The side ports can also limit the flow rate into and/or out of the bag, slowing the process of removing excess fluid from the bag or loading fluid into the bag.

Zipper-type closures have been developed for bags in some uses. Zipper closures allow for larger and wider openings than typical side ports, thereby allowing easy cleaning of the interior of the bags. Zipper openings also ease the process of removing and adding fluid to the bag, in speed, convenience and cleanliness. However, common zipper closures are not suitable for most sporting activities. The bags often receive forceful blows during regular use, causing large increases in fluid pressure inside the bag. Elements used to close the opening often need to be reinforced to ensure closure during use. For example, the caps on side ports are often threaded. However, zippers are often only a small portion of the length of the entire opening, leaving much of the opening exposed to rupturing upon increased reservoir fluid pressure.

Roll-top closures satisfy the above demands: reinforced openings capable of withstanding high-pressure; ease of internal reservoir cleaning; and rapid, convenient, and clean liquid addition and removal. However, some users feel that roll-top closures are cumbersome and slow to open and close.

Therefore, a closeable reservoir system is desired that is capable of ease of internal reservoir cleaning. A closeable reservoir system is also desired that can provide rapid, convenient and clean liquid addition and removal. It is also desired to have a closeable reservoir system that can withstand significantly increased fluid pressures without leaking. A closeable reservoir system is also desired that is easy and fast to open and close.

BRIEF SUMMARY OF THE INVENTION

A reservoir closure system is disclosed. The system has a container, such as a bag, and a sealing member.

The container can have a reservoir and an orifice. The orifice can have closed and open configurations. The reservoir can be in fluid communication with the orifice. The orifice can have an orifice closed length when the orifice is in the closed configuration.

The sealing member can be configured to slidably attach to the container. The sealing member can have has a seal length. The seal length can be at least substantially equal to the orifice closed length. The sealing mechanism can be configured to seal the container. The sealing member can have a substantially straight configuration.

The container can have a first catch having a first catch bottom. The first catch bottom can have a first catch angle. The first catch angle can be less than about 90degrees.

The sealing member can have one or more sealing member arms. The sealing member arms can be configured to attachably engage the catches of the container. The sealing member arms can have angled faces that correspond to angled faces on the catches. Any or all of the angles of the angled faces of the arms can be substantially equal to the angles of the angled faces of the corresponding angled faces of the catches.

The container can have a first end and a first side, and wherein the orifice is at the first end. The container can have an opening on the first side of the container. The reservoir system can have a cap removably attached to the opening. The cap can have a socket configured to attach to a tube.

The sealing member can be tethered to the container. The sealing member can be configured to be interference fit to the container.

DETAILED DESCRIPTION

Figure 1:
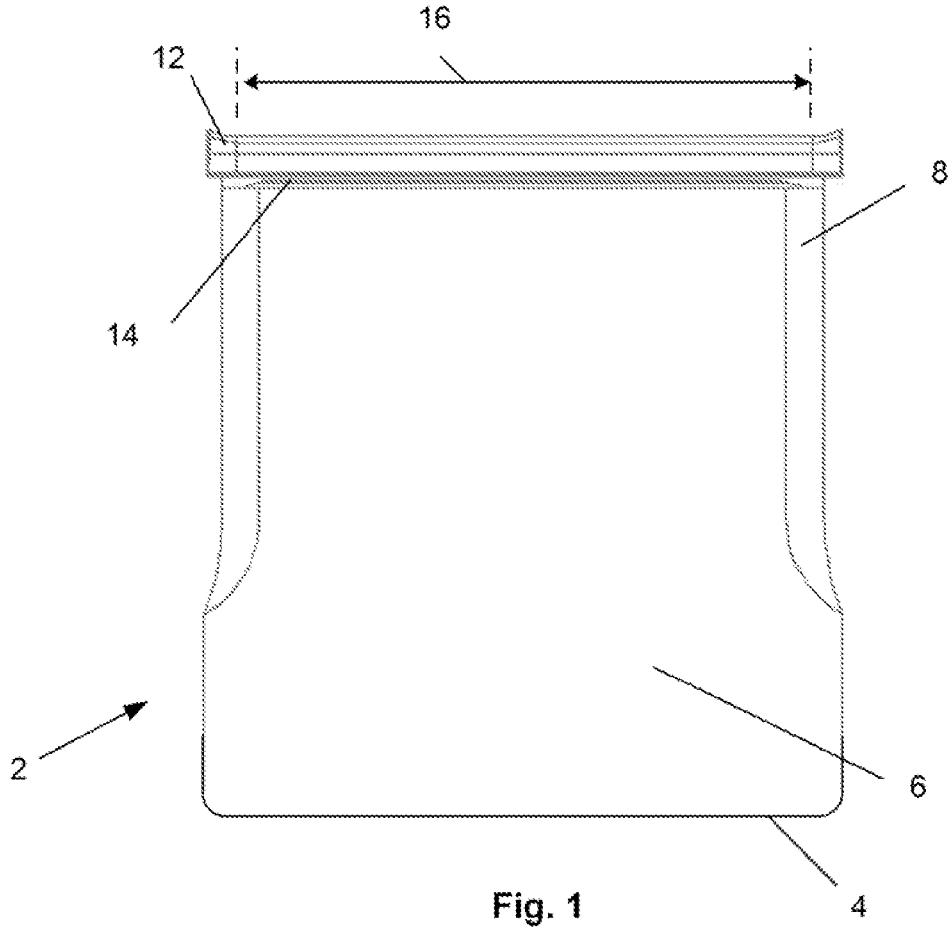
FIG. 1 illustrates an embodiment of the reservoir system.

FIG. 1 illustrates that a reservoir system 2 can have a reservoir container, such as a bag 4, and a sealing member, such as an elongated slider 12. The bag 4 can have a reservoir 6, such as one or more hollows. Multiple reservoirs (not shown) in the bag 4 can be divided into one or more separate compartments by one or more septa, bladders and/or other dividers.

The bag 4 can have a bag reinforcement 8, such as a bag seal. The bag reinforcement 8 can strengthen one or more higher-probability mechanical failure areas on the bag 4. The bag seal 8 can have thicker dimensions than the surrounding material. The bag seal 8 can have layers of the material of the bag 4 or a different material attached to and/or integral with the bag 4. The bag seal 8 can be along all or part (as shown) of the circumference of the bag 4, for example, excluding the portion of the bag adjacent to the orifice 10.

The slider 12 and the bag can be configured to facilitate slidably translating the slider 12 on the bag. The bag can have a guide. The guide can direct the slider 12 during use.

The slider 12 can have a slider seal configured to seal the orifice 10. The slider seal can be, for example, the location on the slider 12 where the dimensions of slider arms provide sufficient force on the bag 4 to seal the bag 4 with the slider 12 on the bag 4. The slider seal can have a slider seal length 16. The slider seal length 16 can be from about 5 cm (2 in.) to about 91 cm (36 in.), more narrowly from about 5 cm (2 in.) to about 46 cm (18 in.), yet more narrowly from about 17 cm (6.5 in.) to about 18 cm (7.0 in.), for example, about 17 cm (6.5 in.).

Figure 2:
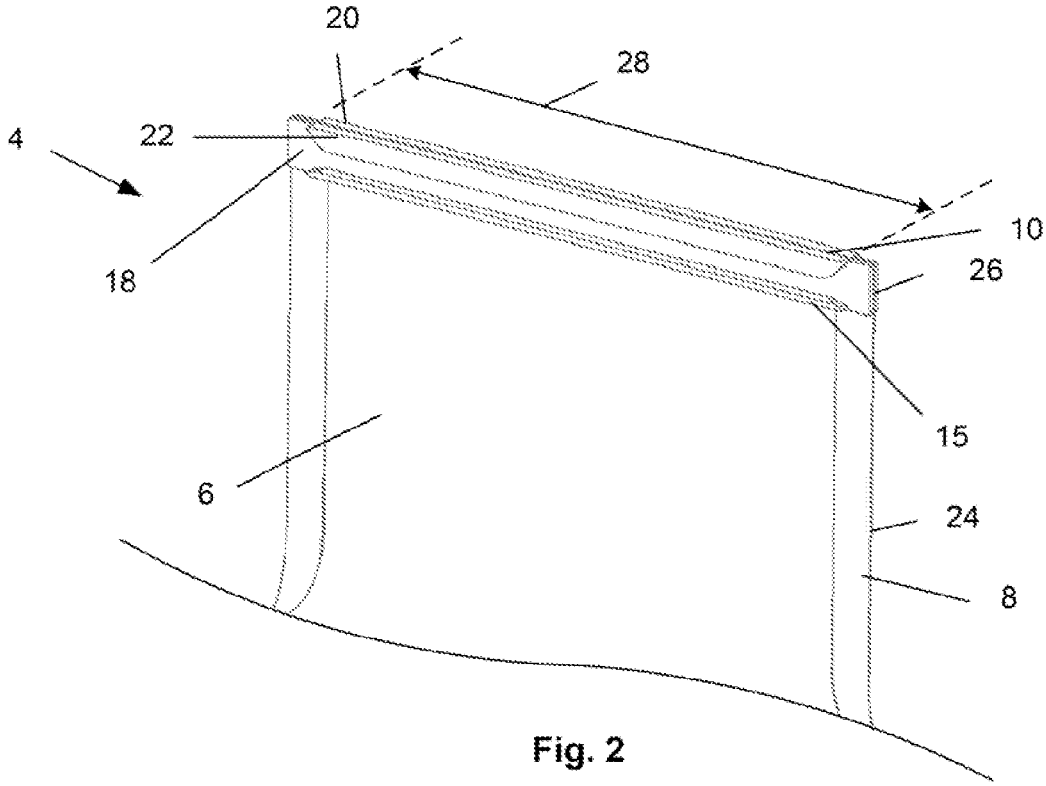
FIG. 2 is a perspective view of an embodiment of the top of the bag.

FIG. 2 illustrates that the bag 4 can have a first lip 17 (partially hidden) and second lip 18, for example, adjacent to the orifice 10. The first lip 17 can be opposite the second lip 18. The lips 17, 18 can be reinforced. The lips 17, 18 can be thicker and/or otherwise more reinforced and/or stronger than the surrounding bag material. The first lip 17 can have one or more first engagement members, such as first catches 20. The second lip 18 can have one or more second engagement members, such as second catches 22.

The bag 4 can be made from a single sheet or from separate sheets, for example, integrated and/or attached at bag seams 24. The lips 17, 18 can have lip seams 26. The lip seams 26 can be part of the bag seams 24. The seams can be leak-proof and water-tight.

The orifice can have an orifice length 28, for example in a closed configuration. The orifice length 28 can be equal to or less than the slider seal length 16. The orifice length 28 can be from about 3.8 cm (1.5 in.) to about 90.1 cm (35.8 in.), more narrowly from about 3.8 cm (1.5 in.) to about 45.2 cm (17.8 in.), yet more narrowly from about 15 cm (6.0 in.) to about 17 cm (6.8 in.), for example, about 15 cm (6.0 in.).

The bag 4 can have an opening on either or both sides of the bag 4. A removable cap can cover the opening. The cap can be attached by an interference or screw interface, for example. The cap can be as disclosed by U.S. patent application Ser. No. 11/445,771. filed Jun. 2, 2006, which is now abandoned, and herein incorporated by reference in its entirety.

The bag 4 can have a fitment for sealably attaching to or otherwise interfacing with, for example, one or more valves, a nozzle interface, a tube interface, a nozzle, a tube (e.g., a straw), a plug, or combinations thereof. The fitment can be a socket. The fitment can be over the opening on either or both sides of the bag 4. The fitment can be the cap. The fitment can be or have a port or socket.

Figure 3A:
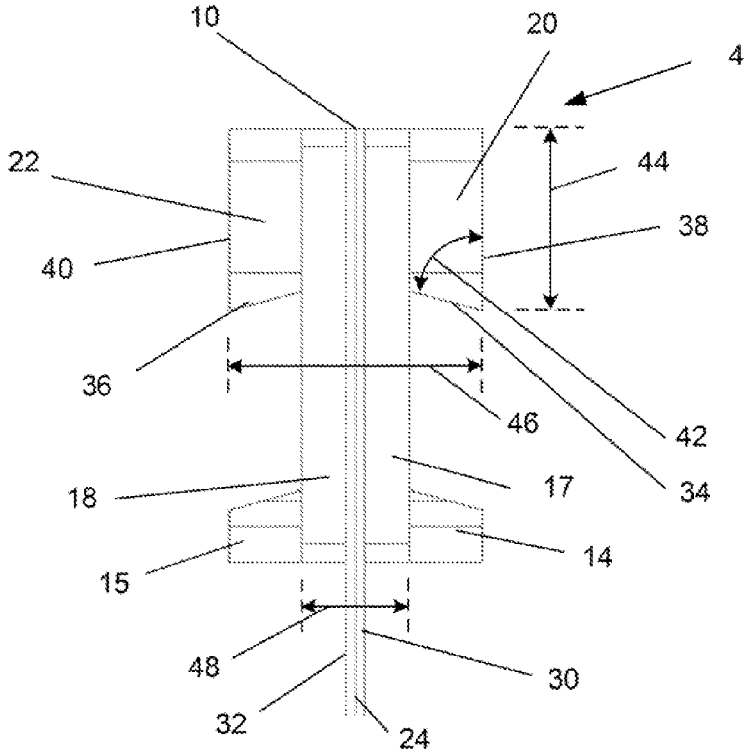
FIGS. 3*a* through 3*g* are side views of various embodiments of the top of the bag.

FIG. 3*a* illustrates that the bag 4 can have a bag first side 30 and a bag second side 32. The bag first side 30 can be made from at least the same or a different sheet of material from the bag second side 32.

The first and second 20, 22 catches can have first and second catch bottoms, 34, 36 respectively. The first and second 20, 22 catches can have first and second 38, 40 catch sides, respectively. The first and second 38, 40 catch sides can be substantially parallel with the lip seams 26, and/or the lips 17, 18, and/or the bag seam 24, and/or the bag first side 30 and/or second side 32. The angle formed by the catch bottom and the catch side can be a catch angle 42. The catch angle 42 can be less than about 90°. The catch angle 42 can be from about 0° to about 90°, more narrowly from about 30° to about 80°, yet more narrowly from about 45° to about 75°,for example, about 70°.

The catches can have a catch height 44. The catch height 44 for the first catch 20 can be the same as or different from the catch height 44 of the second catch 22. The catch height 44 can be from about 2 mm (0.08 in.) to about 100 mm (3.9 in.), more narrowly from about 2 mm (0.08 in.) to about 30 mm (1.2 in.) for example, about 5 mm (0.2 in.).

The distance from the first catch side 38 to the second catch side 40 can be a combined catch width 46. The combined catch width 46 can be from about 1.5 mm (0.059 in.) to about 100 mm (3.94 in.), for example, about 7 mm (0.3 in.).

The first and second lips 17, 18 can have a combined lip width 48. The combined lip width 48 can be from about 1.0 mm (0.039 in.) to about 100 mm (3.9 in.), for example, about 3 mm (0.1 in.).

Figure 3B:
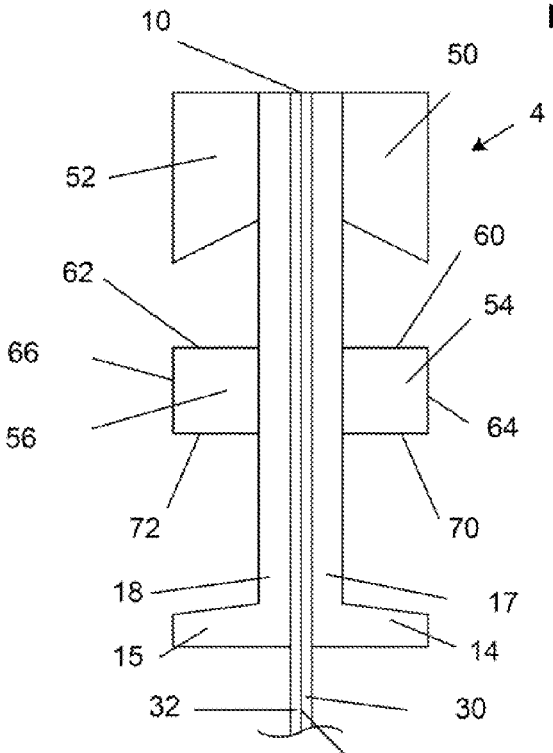
Figure 3C:
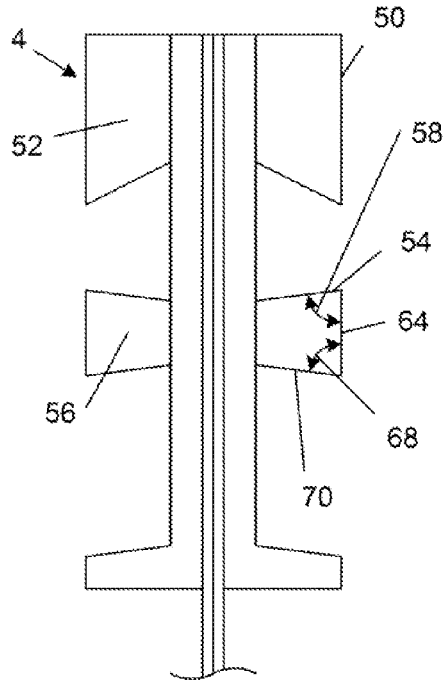

FIGS. 3*b* and 3*c* illustrate that the lips 17, 18 can have a first upper catch 50 (similar to the first catch described supra) and a second upper catch 52 (similar to the second catch described supra). The lips 17, 18 can have a first lower catch 54 and a second lower catch 56. The first 54 (and second 56) lower catch can have a first 58 (and second 60, respectively) lower catch top angle between the first 60 (and second 62, respectively) lower catch top and the first 64 (and second 66, respectively) lower catch side. The first 54 (and second 56) lower catch can have a first 54 (and second 56, respectively) lower catch bottom angle 68 between the first 64 (and second 66, respectively) lower catch side and the first 70 (and second 72, respectively) lower catch bottom. The lower catch angles can be about 90°. The lower catch top angles 58 can be equal or unequal to the lower catch bottom angles 68. The lower catch top 58 and/or bottom 68 angles can be less than about 90°, for example from about 0° to about 90°, more narrowly from about 30° to about 80°, more narrowly from about 45° to about 75°, for example about 75°.

Figure 3D:
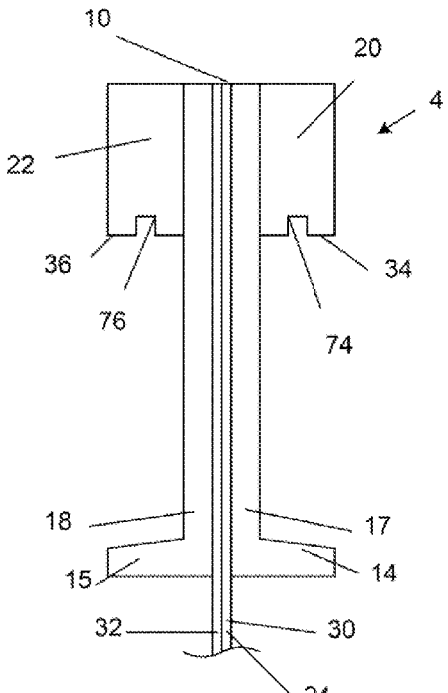

FIG. 3*d* illustrates that the first 34 and/or second 36 catch bottoms can have one or more recessed interlockable elements, such as, respectively, first and/or second catch notches, recesses, slots, or grooves 74, 76. The catch grooves 74, 76 can have substantially square or rectangular cross-sections. The catch grooves 74, 76 can be extend along all or part of the length of the catch bottoms 34, 36. Although shown with a catch angle of 90°, the catch angle can be any catch angle disclosed herein.

Figure 3E:
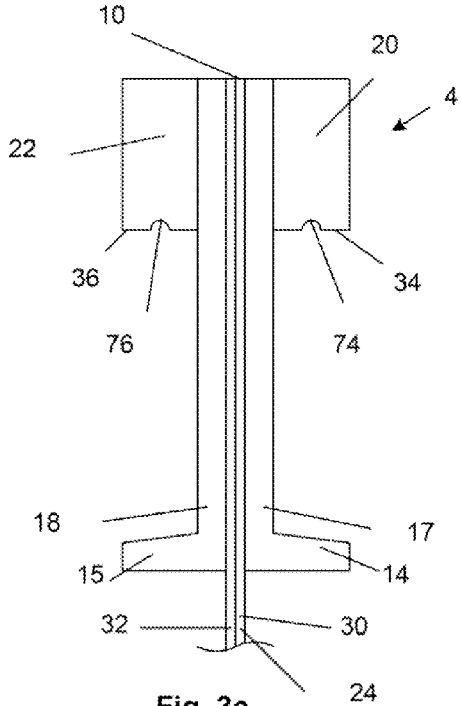
Figure 3F:
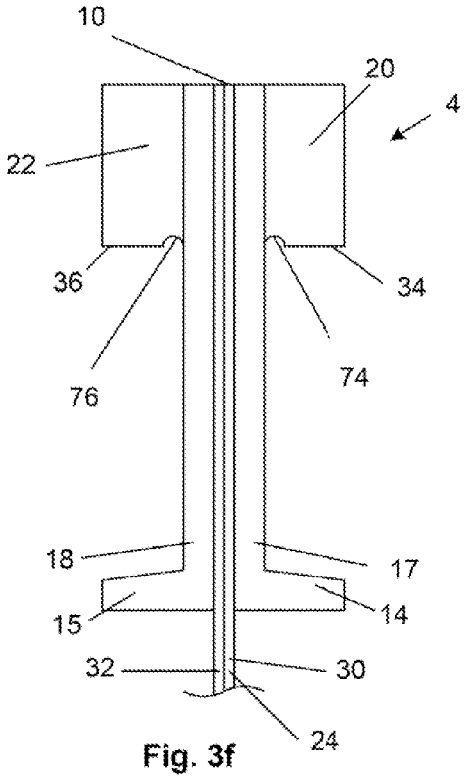

FIG. 3*e* illustrates that the catch grooves 74, 76 can have substantially round (e.g., hemispherical, hemi-oval, otherwise partially spherical or oval) cross-sections. FIG. 3*f* illustrates that the first and second catch grooves 74, 76 can be immediately adjacent to the first and second lips 17, 18, respectively.

Figure 3G:
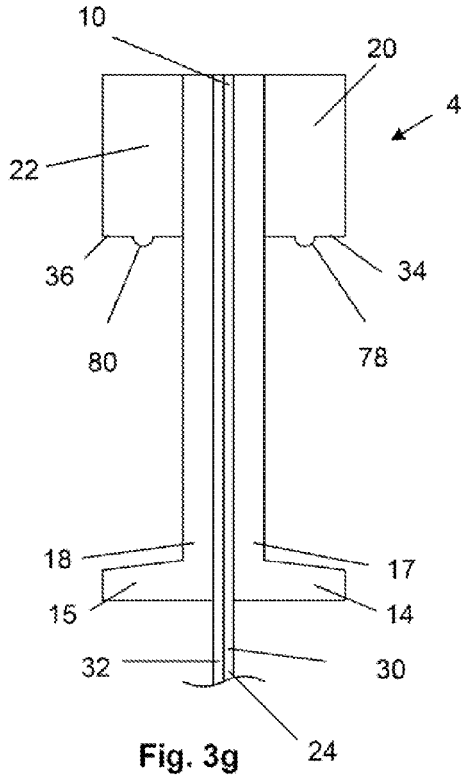

FIG. 3*g* illustrates that the first 34 and/or second 36 catch bottoms can have one or more extending interlockable elements, such as, respectively, first and/or second catch bumps, buttons or ridges 78, 80. The catch ridges 78, 80 can have substantially inverted configurations of the configurations disclosed for the catch grooves 74, 76.

Figure 4:
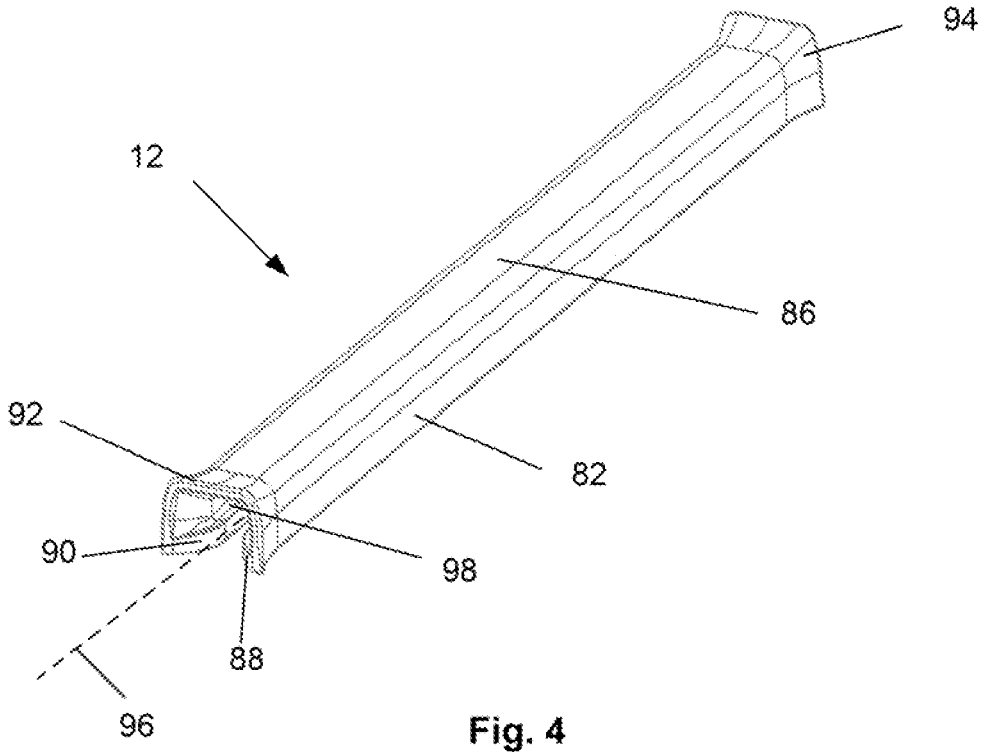
FIG. 4 is a perspective view of an embodiment of the slider.

FIG. 4 illustrates that the slider 12 can have a substantially straight longitudinal center axis 96. The slider 12 can have a slider first side 82 and/or a slider second side 84 and a slider top 86. The slider first side 82 and/or a slider second side 84 can extend substantially at a right angle or other non-zero angle from a slider top 86. The slider first side 82 can have a slider first arm 88. The first and second slider arms 88, 90 can extend substantially at a right angle or other non-zero angle from the first and second slider sides 82, 84, respectively. The ends of the slider arms 88, 90 can taper.

The slider 12 can have a first slider end 92 and/or a second slider end 94. The slider ends 92, 94 can flare or otherwise expand radially away from the longitudinal center axis 96.

The slider ends 92, 94 can include the ends of the slider sides 82, 84, and/or the ends of the slider arms 88, 90, and/or the ends of the slider top 86.

A hollow elongated slider channel 98 can be defined by the slider top 86 and/or the slider sides 82, 84 and/or the slider arms 88, 90. The slider 12 can be flexible or rigid. The slider 12 can have one or more flexible first segments (e.g., the slider ends) and one or more rigid second segments (e.g., the remainder of the slider 12 other than the ends).

Figure 5:
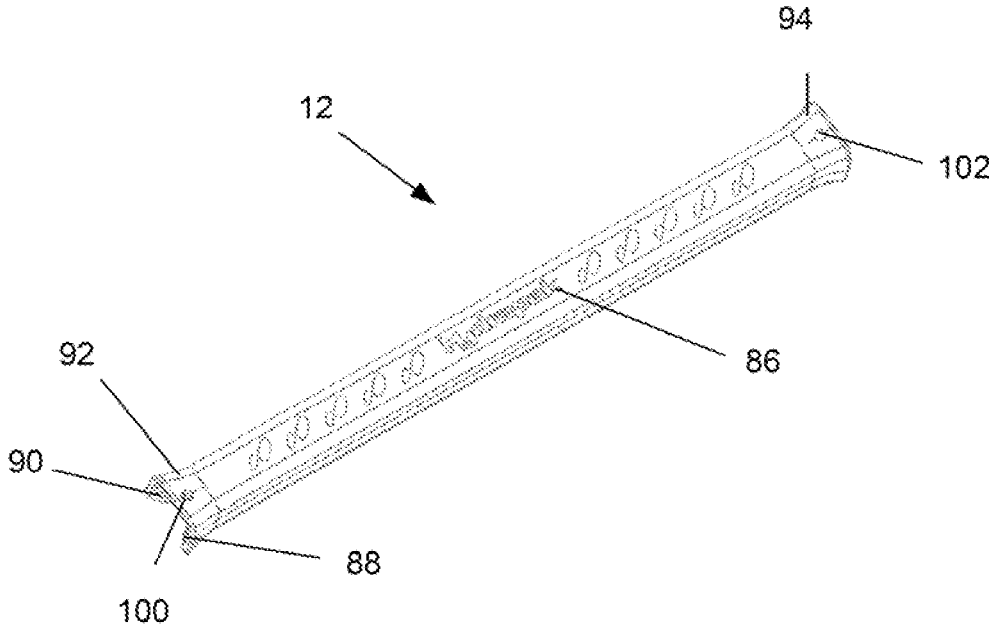
FIG. 5 is a top view of an embodiment of the slider.

FIG. 5 illustrates that the slider 12 can have information thereon printed, embossed, otherwise marked, or combinations thereof. The information can be instructions or marketing information (e.g., branding) on the slider top 86 and/or slider sides 82, 84 and/or slider arms 88, 90.

The slider 12 can have a slider first hole 100, for example at the slider first end 92. The slider 12 can have a slider second hole 102, for example at the slider second end 94. The slider holes 100, 102 can be on the slider top 86.

Figure 6A:
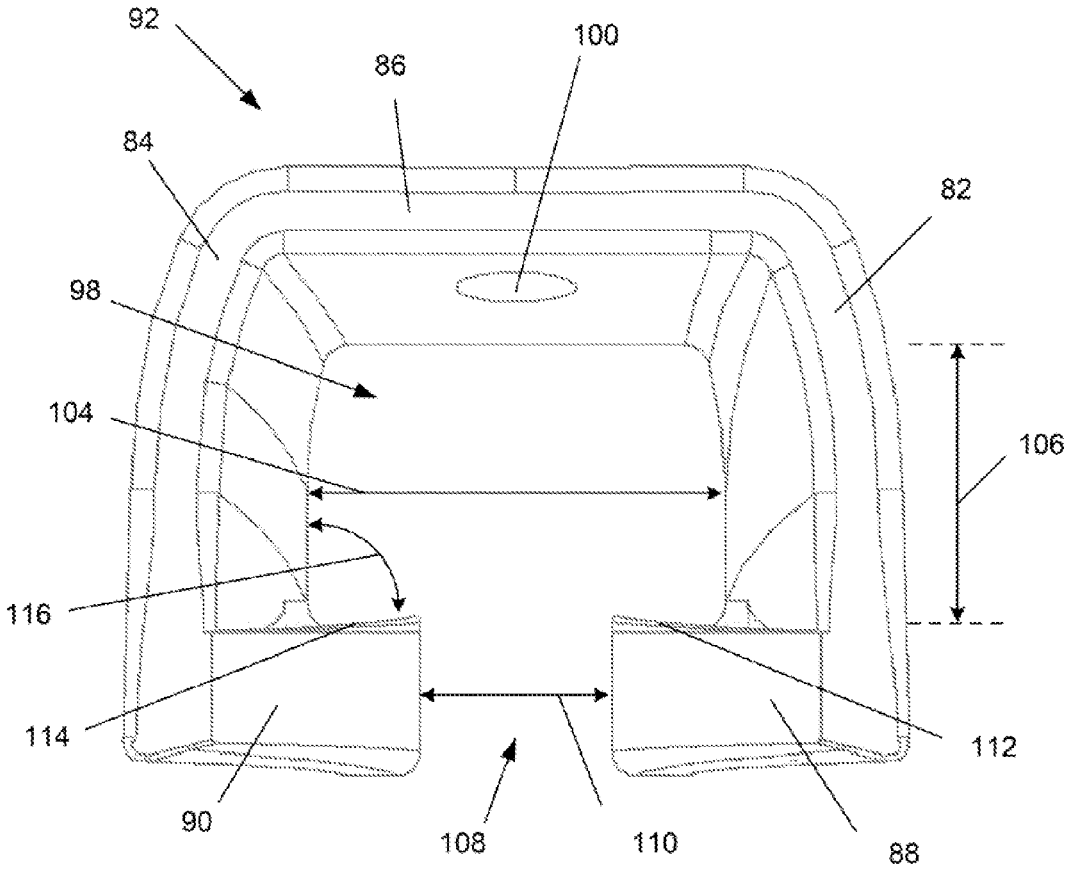
FIGS. 6*a* through 6*g* are side views of various embodiments of the first end of the slider.

FIG. 6*a* illustrates that the slider channel 98 can have a slider channel width 104 and a slider channel height 106. The slider channel width 104 can be from about 2 mm (0.08 in.) larger than the combined catch width 46 to about 130 mm (5 in.) larger than the combined catch width 46, more narrowly from about 2 mm (0.08 in.) larger than the combined catch width 46 to 8 about 5 mm (0.2 in.) larger than the combined catch width 46, for example about 2 mm (0.08 in.) larger than the combined catch width 46. The slider channel height 106 can be from about 2 mm (0.08 in.) larger than the catch height 44 to about 130 mm (5 in.) larger than the catch height 44, for example about 2 mm (0.08 in.) larger than the catch height 44.

The slider 12 can have a slider gap 108. The slider gap 108 can be defined between the slider first arm 88 and the slider second arm 90. The slider gap 108 can have a slider gap width 110. The slider gap width 110 can be the distance from the slider first arm 88 to the slider second arm 90. The slider gap width 110 can be from about 10 mm (0.4 in.) smaller than the combined lip width 48 to about 10 mm (0.4 in.) larger than the combined lip width 48, more narrowly from about than the combined lip width 48 to about 5 mm (0.2 in.) smaller than the combined lip width 48, yet more narrowly from about 1 mm (0.04 in.) smaller than the combined lip width 48 to about 5 mm (0.2 in.) smaller than the combined lip width 48, for example about 5 mm (0.2 in.) smaller than the combined lip width 48.

The slider first and second arms 88, 90 can have slider first and second arm tops 112, 114, respectively. The slider 12 can have one or more slider arm angles 116. The slider arm angles 116 can be the angle from the first slider arm top 112 to the slider first side 82 and/or from the second slider arm top 114 to the slider second side 84. The slider arm angles 116 can be the same or different on each side of the slider 12 (i.e., on the slider first side 82 and the slider second side 84). The slider arm angles 116 can be in the same ranges and the example provided, supra, for the catch angle. The slider arm angles 116 can be equal to the corresponding catch angles.

Figure 6B:
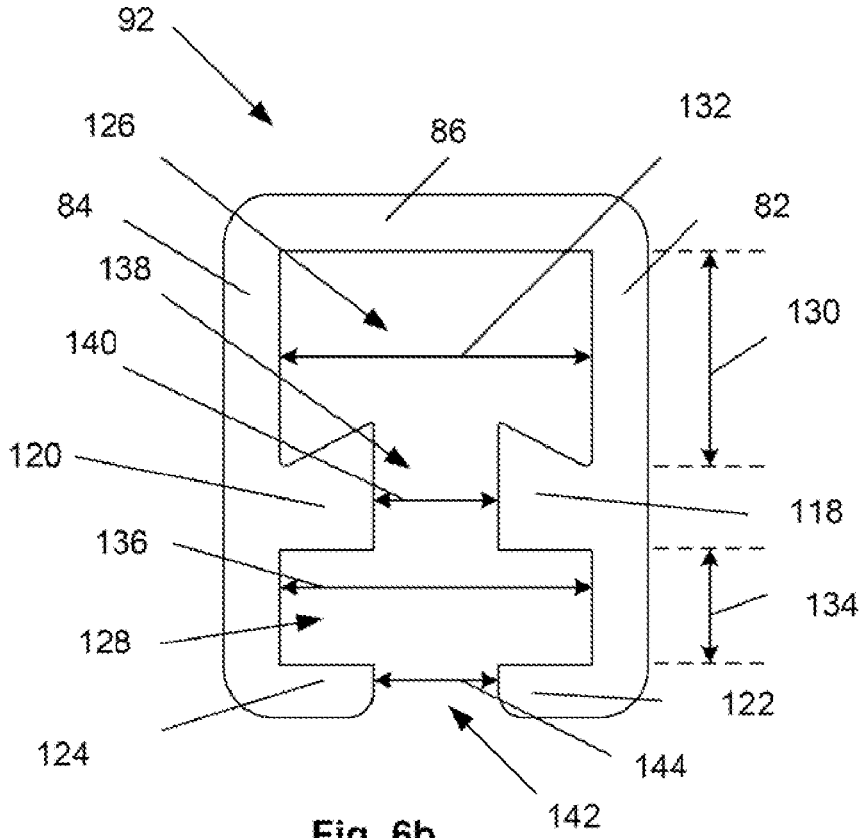

FIG. 6*b* illustrates that the slider 12 can have upper arms (e.g., a slider first upper arm 118 and a slider second upper arm 120) and lower arms (e.g., a slider first lower arm 122 and a slider second lower arm 124). The slider 12 can have a slider upper channel 126. The slider upper channel 126 can be defined by the slider top 86, the slider first side 82, the slider second side 84, and the slider upper arms 118, 120. The slider 12 can have a slider lower channel 128. The slider lower channel 128 can be defined by the slider first side 82, the slider second side 84, the slider upper arms 118, 120, and the slider lower arms 122, 124.

The slider upper channel 126 can have a slider upper channel height 130 and a slider upper channel width 132. The slider lower channel 128 can have a slider lower channel height 134 and a slider lower channel width 136.

The slider upper channel width 132 and the slider lower channel width 136 can be from about can be from about 10 mm (0.4 in.) smaller than the combined catch width 46 to about 10 mm (0.4 in.) larger than the combined catch width 46, more narrowly from about than the combined catch width 46 to about 5 mm (0.2 in.) smaller than the combined catch width 46, yet more narrowly from about 1 mm (0.04 in.) smaller than the combined catch width 46 to about 5 mm (0.2 in.) smaller than the combined catch width 46, for example about 5 mm (0.2 in.) smaller than the combined catch width 46. The slider upper channel width 132 can be the same as or different than the slider lower channel width 136.

The slider upper channel height 130 and the slider lower channel height 134 can be from about 10 mm (0.4 in.) smaller than the upper or lower catch height to about 10 mm (0.4 in) larger than the upper or lower catch height, more narrowly from about 5 mm (0.2 in.) smaller than the upper or lower catch height to about 5 mm (0.2 in.) larger than the upper or lower catch height, for example about 2 mm (0.08 in.) larger than the upper or lower catch height. The slider upper channel height can be the same as or different than the slider lower channel height 134.

The slider 12 can have a slider upper gap 138. The slider upper gap 138 can be defined between the slider first upper arm 118 and the slider second upper arm 120. The slider upper gap 138 can have a slider upper gap width 140. The slider 12 can have a slider lower gap. The slider lower gap 142 can be defined between the slider first lower arm 122 and the slider second lower arm 124. The slider lower gap 142 can have a slider lower gap width 144.

The slider upper gap width 140 and the slider lower gap width 144 can be the distance from the slider first upper arm 118 to the slider second upper arm 120. The slider upper gap width 140 can be from be from about 10 mm (0.4 in.) smaller than the combined lip width 48 to about 10 mm (0.4 in.) larger than the combined lip width 48, more narrowly from about than the combined lip width 48 to about 5 mm (0.2 in.) smaller than the combined lip width 48, yet more narrowly from about 1 mm (0.04 in.) smaller than the combined lip width 48 to about 5 mm (0.2 in.) smaller than the combined lip width 48, for example about 5 mm (0.2 in.) smaller than the combined lip width 48. The slider upper gap width 140 can be the same as or different than the slider lower gap width 144.

Figure 6C:
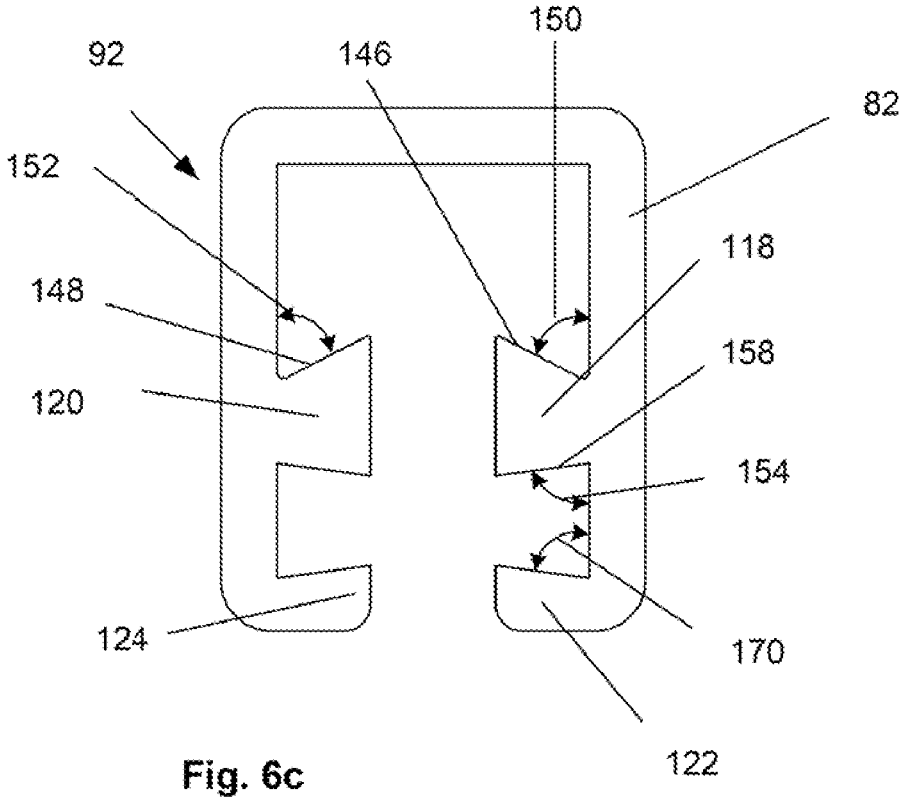

FIG. 6*c* illustrates that the slider upper and/or lower arms 118, 120 can have dovetail or other flared configurations. The slider first and second upper arms 118, 120 can have slider first and second upper arm tops 146, 148, respectively. Slider first and second upper arm top angles 150, 152 can be defined between the slider first and second upper arm tops 146, 148, and the slider first and second sides 82, 84, respectively (as shown).

The slider first and second arm top angles 150, 152 can be selected from the range or example provided herein for the upper catch angle 44. The slider first and second arm top angles 150, 152 can be greater than, less than, or equal to the upper catch angle 44.

The slider upper arms 118, 120 can have slider upper arm bottoms 158, 160. Slider first and second upper arm bottom angles 154, 156 can be defined between the slider first and second upper arm bottoms 158, 160, and the slider first and second sides 82, 84, respectively (as shown).

The slider first and second arm bottom angles 154, 156 can be selected from the range or example provided herein for the lower catch top angle 58. The slider first and second arm bottom angles 154, 156 can be greater than, less than, or equal to the lower catch top angle 58.

Slider first and second lower arm top angles 162, 164 can be defined between the slider first and second lower arm tops 166, 168, and the slider first and second sides 82, 84, respectively (as shown). The slider first and second lower arm angles 170, 172 can be can be selected from the range or example provided herein for the lower catch bottom angle 68. The slider first and second lower arm angles 170, 172 can be greater than, less than, or equal to the lower catch bottom angle 68.

Figure 6D:
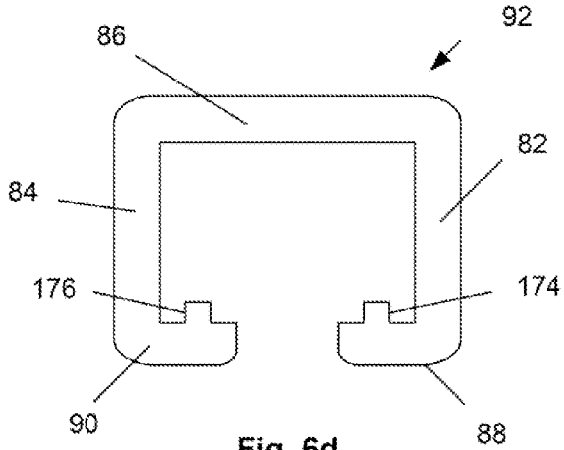

FIG. 6*d* illustrates that the slider first and/or second arms 88, 90 can have one or more extended interlockable elements, such as, respectively, first and/or second arm bumps, buttons or ridges 174, 176. The arm ridges 174, 176 can have substantially square or rectangular cross-sections. The arm ridges 174, 176 can be extend along all or part of the length of the catch bottoms. Although shown with a catch angle of 90°, the catch angle can be any catch angle disclosed herein.

Figure 6E:
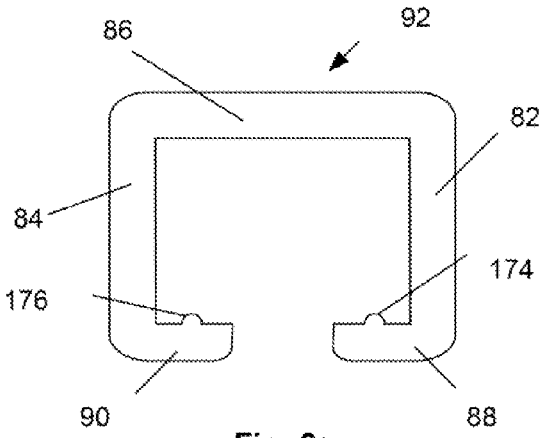
Figure 6F:
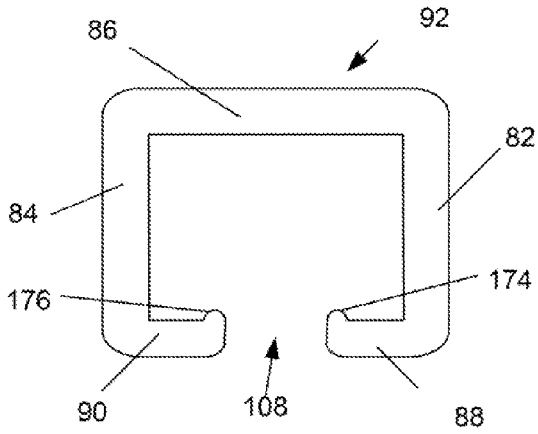

FIG. 6*e* illustrates that the arm ridges 174, 176 can have substantially round (e.g., hemispherical, hemi-oval, otherwise partially spherical or oval) cross-sections. FIG. 6*f* illustrates that the first and second arm ridges 174, 176 can be immediately adjacent to the slider gap 108.

Figure 6G:
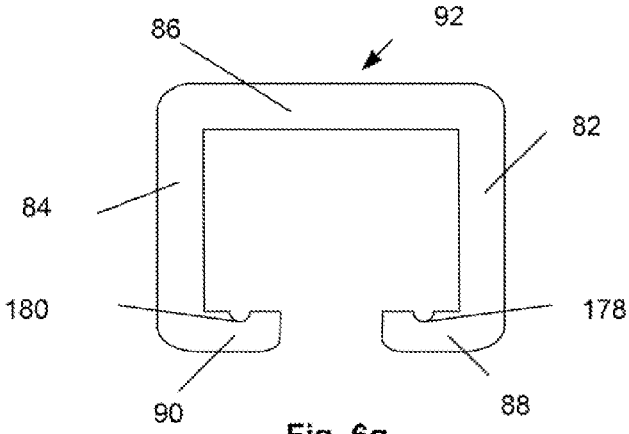

FIG. 6*g* illustrates that the first 88 and/or second 90 slider arms can have one or more recessed interlockable elements, such as, respectively, first and/or second arm notches, recesses, slots, or grooves 178, 180. The arm grooves 178, 180 can have substantially inverted configurations of the configurations disclosed for the arm ridges 174, 176.

The catch grooves 74, 76 can be configured to interference fit with the arm ridges. The catch ridges 78, 80 can be configured to interference fit with the arm grooves 178, 180.

The bag 4 can be configured similar to and/or have any elements and/or configurations of the bag disclosed in U.S. Pat. No. 6,267,506, which is herein incorporated by reference in its entirety. If the top of the bag 4 is rolled in a closed configuration, as shown in U.S. Pat. No. 6,267,506, the bag can be configured, when in the rolled configuration, to form substantially similar configurations to the first 20 and/or second catches 22. The first and/or second catches 20, 22 can be formed by the splint(s) and/or fold(s) and/or flap(s) and/or other components disclosed in U.S. Pat. No. 6,267,506.

The bag, slider, and any and all other elements described herein can be made from polyethylene, such as high density polyethylene (HDPE) or low density polyethylene (LDPE) (e.g., linear LDPE), polytetrafluoroethylene (PTFE), polyurethane (e.g., thermoplastic polyurethane (TPU)), polyvinyl chloride (PVC), thermoplastic elastomer (TPE), polyoxymethylene (POM), also known as acetal resin, polytrioxane and polyformaldehyde (e.g., DELRIN® by E.I. DU PONT DE NEMOURS AND COMPANY™, Wilmington, Del.), Nylon, or combinations thereof. For example, the slider can be made from POM and the bag can be made from TPU.

Method of Making

The bag 4 an be molded and/or any and/or all of the elements of the bag 4 can be welded (e.g., RF welded) together. The slider 12 can be molded and/or any and/or all of the elements of the slider 12 can be welded (e.g., RF welded) together.

Methods of Use

Figure 7:
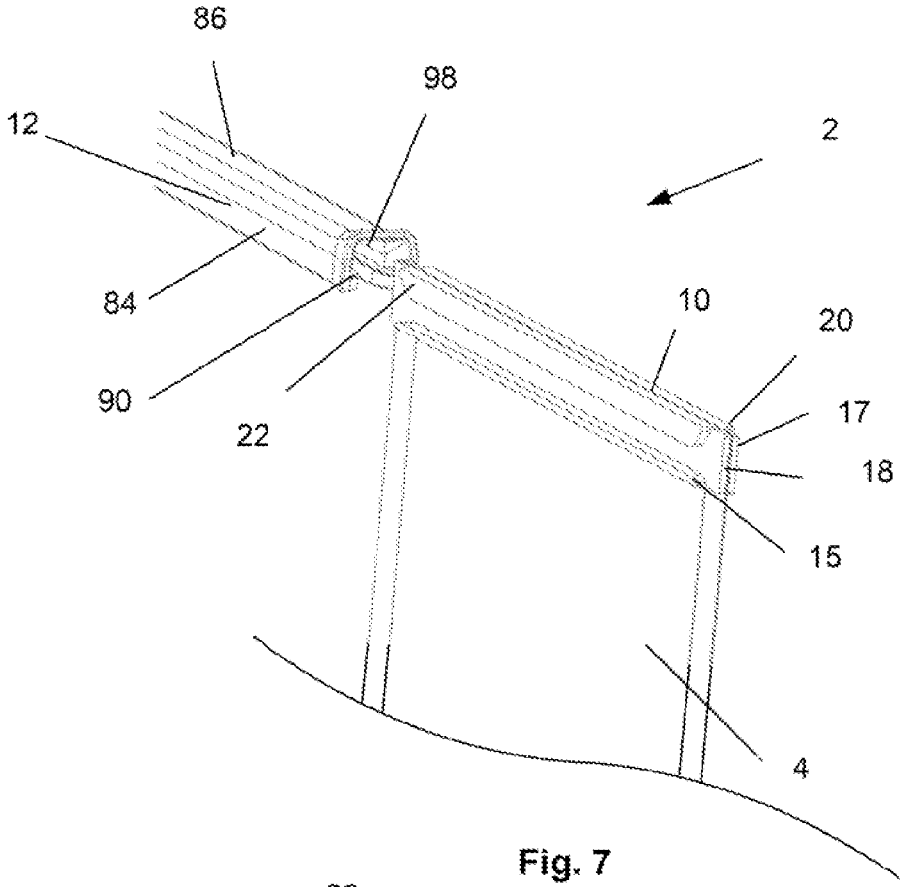
FIGS. 7 through 9 illustrate a sequence of an embodiment of a method of using the slider on the bag.

FIG. 7 illustrates that before sealably closing the orifice 10, the slider 12 can be unattached to the bag 4. The slider 12 can be aligned to the top of the bag 4. The slider channel 98 can be substantially longitudinally aligned with the first and second catches 20, 22.

Figure 8:
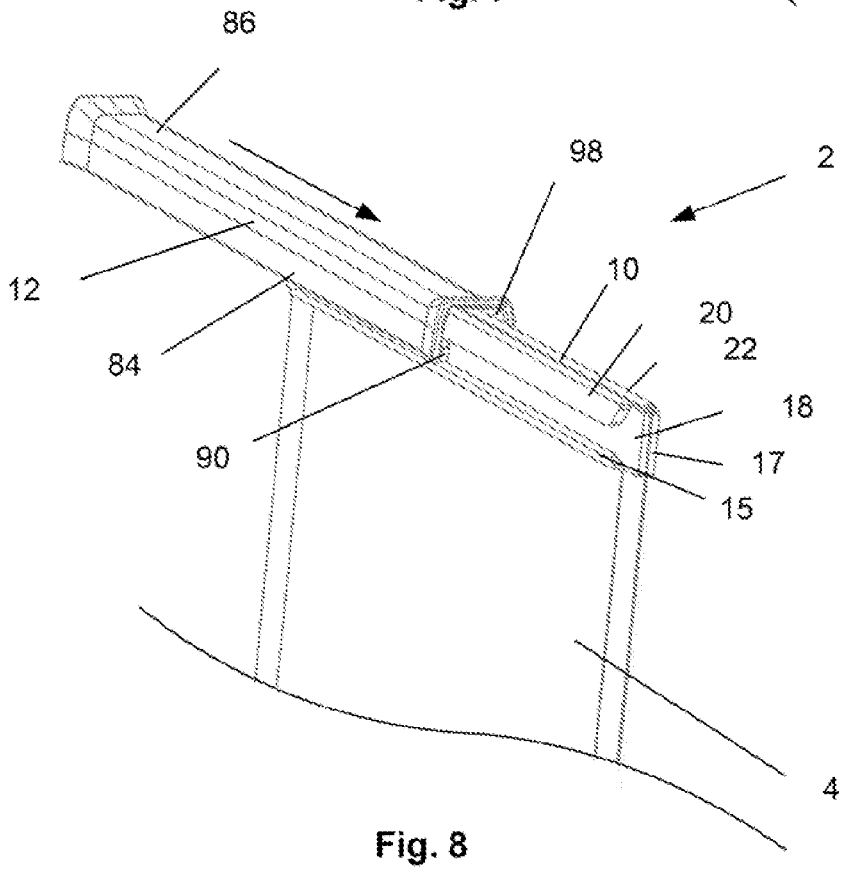

FIG. 8 illustrates that the slider 12 can be translated relative to the bag 4, as shown by arrow. The slider 12 can be slidably attached to the bag 4. The slider 12 can be translated in the direction of the longitudinal center axis. The guides 14, 15, lips 17, 18, and catches 20, 22 can direct the slider arms 88, 90 longitudinally along the top of the bag 4. The tapered configuration of the slider arms 88, 90 can direct the slider arms 88, 90 longitudinally along the top of the bag 4. The slider arms 88, 90 can force the first lip 17 toward the second lip18 . The slider sides 82, 84 can force the first catch 20 toward the second catch 22.

The slider 12 can be unattached from the bag 4 by translating the slider 12 in the direction relative to the bag 4 opposite that shown by the arrow in FIG. 8.

Figure 9:
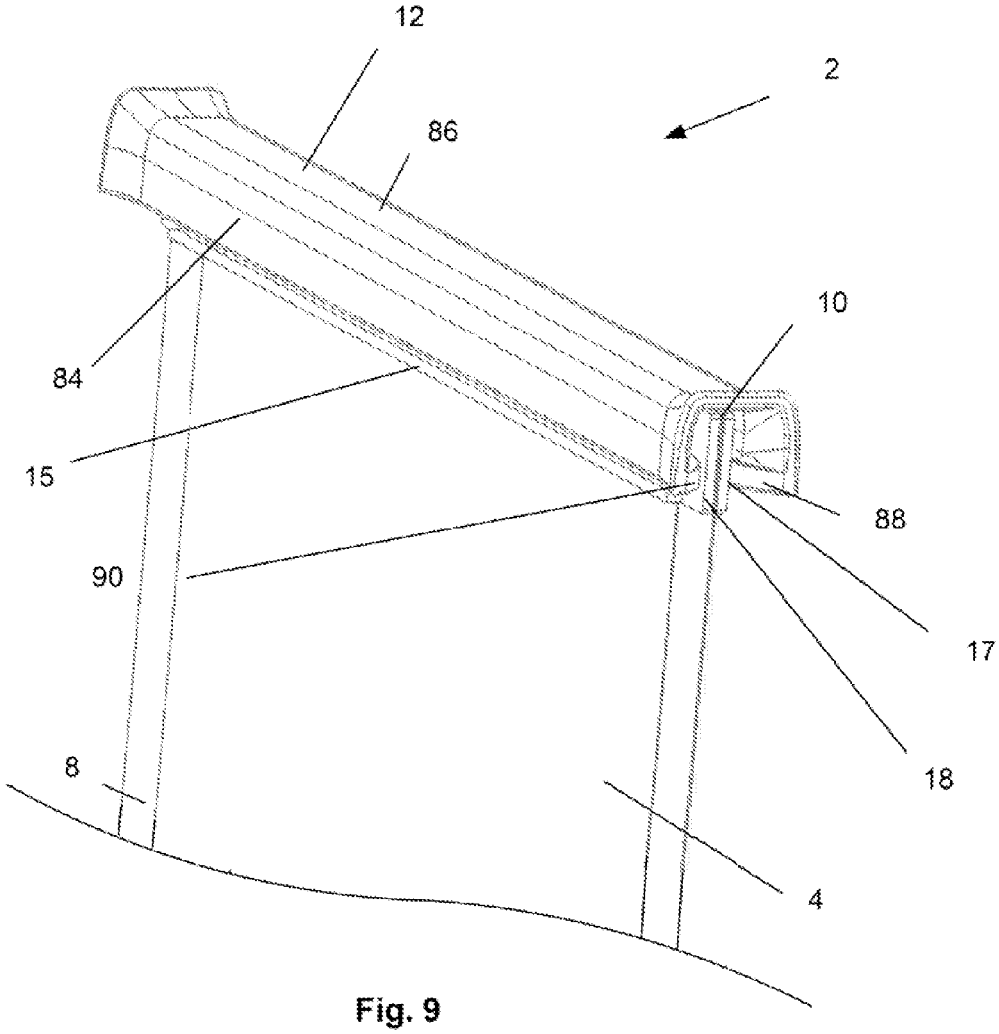

FIG. 9 illustrates that the reservoir system 2 can be in a sealed configuration. The slider 12 can be slidably attached and friction fit to the top of the bag 4. The slider 12 can provide pressure squeezing the orifice 10 closed.

Figure 10A:
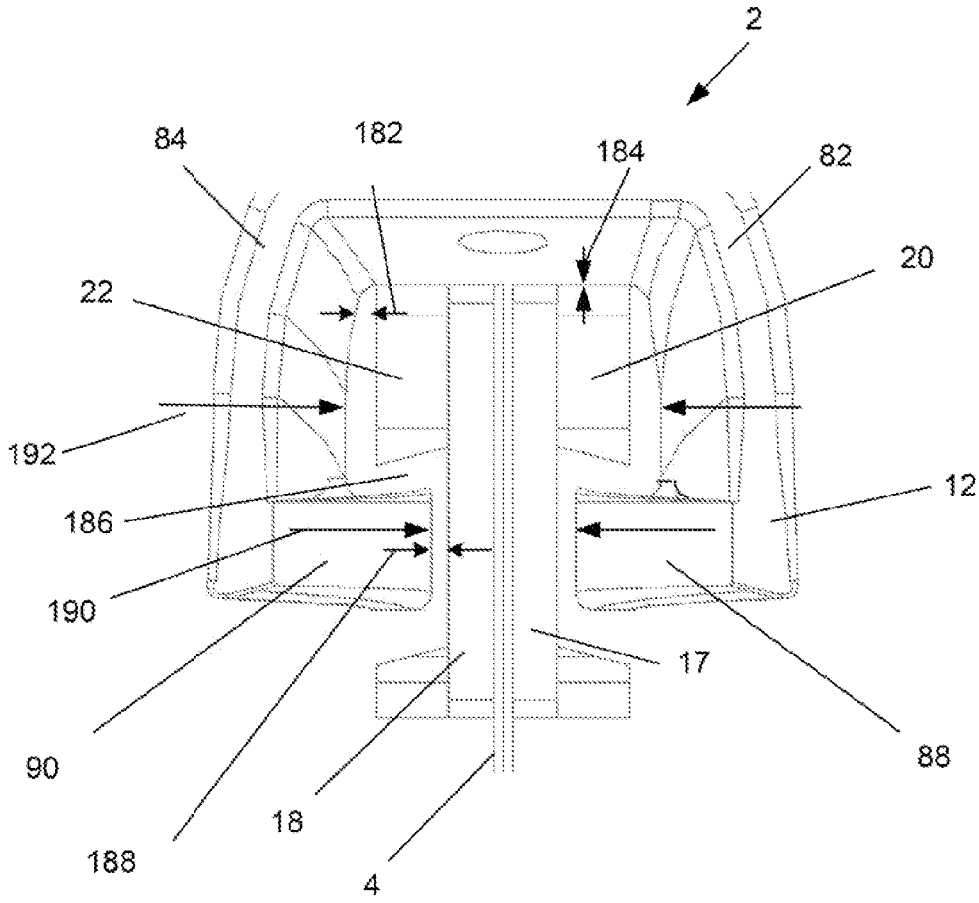
FIGS. 10*a*, 10*b* and 10*c* are side views of various embodiments of the top of the reservoir system.

FIG. 10*a* illustrates that when the slider 12 is attached to the top of the bag 4, the slider 12 can sealably close the orifice 10. The slider 12 can apply pressure on the bag 4 at any combination of the following areas: where the slider top 86 contacts the lips 17, 18 and/or the catch 20, 22; where the catches 20, 22 contact the slider sides 82, 84; where the slider arms 88, 90 contact the catches 20, 22, where the slider arms 88, 90 contact the lips 17, 18, and where the arms 88, 90 contact the guides 14, 15.

The reservoir system 2 can have side-catch gaps 182 between the slider sides 82, 84 can the corresponding catches 20, 22. The reservoir system 2 can have a top-catch gap between the slider top 86 and the catches 20, 22 and/or lips 17, 18. The reservoir system 2 can have arm-catch gaps 186 between the slider arms 88, 90 and the corresponding catches 20, 22. The reservoir system 2 can have arm-lip gaps 188 between the slider arms 88, 90 and the corresponding lips 17, 18. With the slider 12 deployed to sealably close the bag 4, the side-catch gaps 182, top-catch gap 184, arm-catch gaps 186, and arm-lip gaps 188 can be from about 0 mm (0 in.) to about 10 mm (0.4 in.), for example about 0 mm (0 in.).

The slider arms 88, 90 can produce an arm compression force 190, shown by arrows, against the first and second lips 17, 18. The slider sides 82, 84 can produce a side compression force 192, shown by arrows, against the first and second catches 20, 22. The arm 190 and/or side 192 compression forces can minimize and/or prevent fluid leakage from the reservoir 6 out of the orifice 10.

When pressure in the bag 4 increases (e.g., when the bag 4 contains fluid and the bag 4 is squeezed), the first and/or second catches 20, 22 can impair the movement of the slider first and/or second arms 88, 90, respectively, in. an upward direction (with respect to the page of FIG. 10*a*), for example retaining the slider 12 on the bag 4.

Figure 10B:
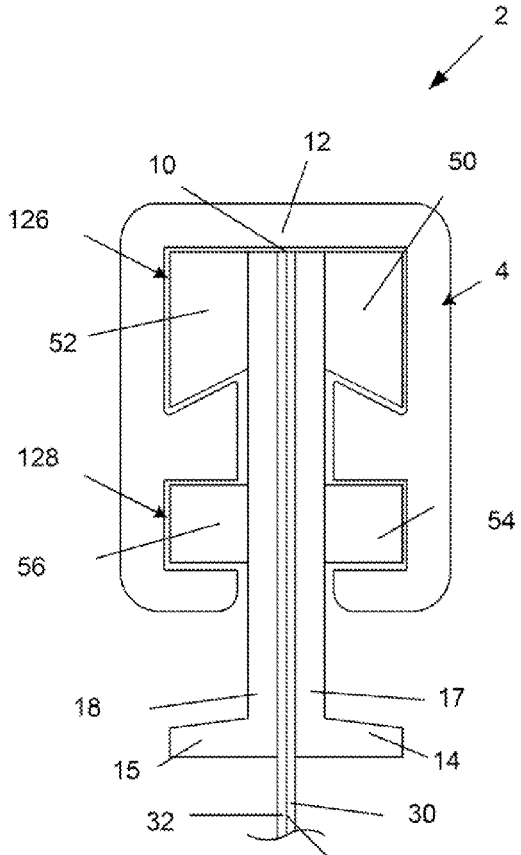
Figure 10C:
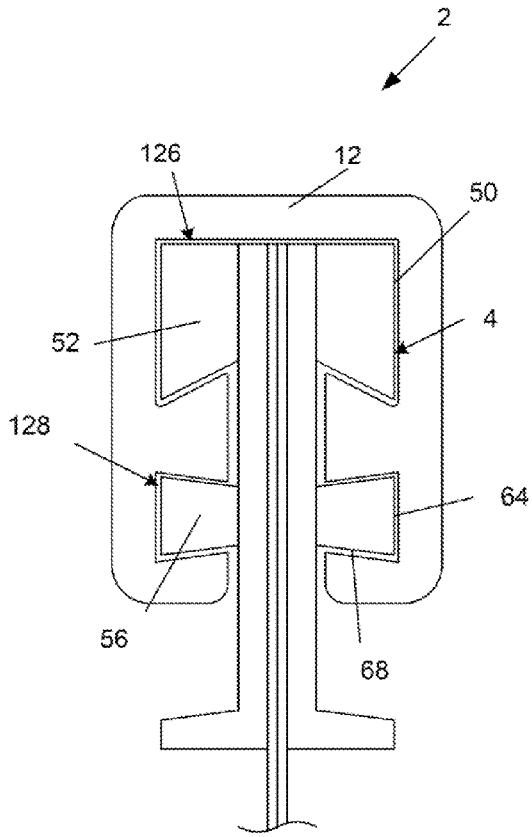

FIG. 10*b* illustrates that the slider 12 of FIG. 6*b* is configured to sealably close the bag 4 of FIG. 3*b*. The upper catches 50, 52 can be configured to engage and slidably attach to the slider upper channel 126. The lower catches 54, 56 can be configured to engage and slidably attach to the slider lower channel 128. FIG. 10*c* illustrates that the slider 12 of FIG. 6*c* is configured to sealably close the bag 4 of FIG. 3*c*.

The slider gaps 108, slider upper gaps 138 and slider lower gaps 142 can be configured to engage and slidably attach to the lips 17, 18.

The bags 4 illustrated in FIGS. 3*d* through 3*g* can be used with sliders 12 illustrated in FIGS. 6*d* through 6*g*, respectively. During use, the catch grooves 74, 76 can interference fit with the arm ridges 174, 176. During use, the catch ridges 78, 80 can interference fit with the arm grooves 178, 180.

Figure 11:
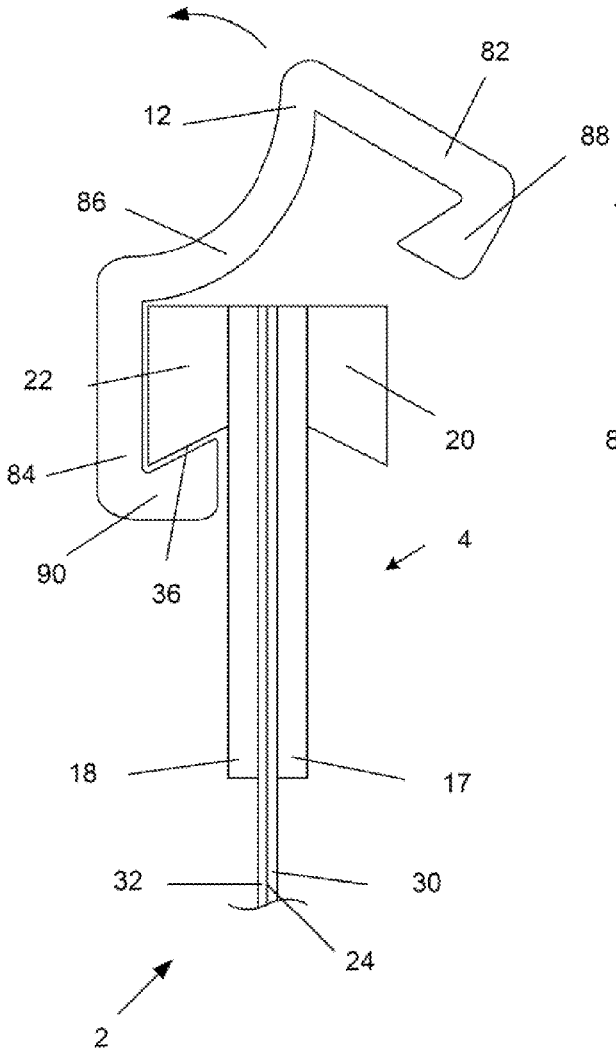
FIGS. 11 and 12 illustrate various embodiments of methods of using the slider on the bag.

FIG. 11 illustrates that the slider top 86 can be resiliently or deformably bendable. The slider top 86 can be rotatably bent, as shown by arrow. The slider second arm 90 can be fixedly attached and/or engaged to the second catch bottom 36. The slider second side 84 can be positioned directly adjacent to the second catch 22. The slider first side 82 and slider first arm 88 can be unattached to and/or disengaged from the first catch 20.

Figure 12:
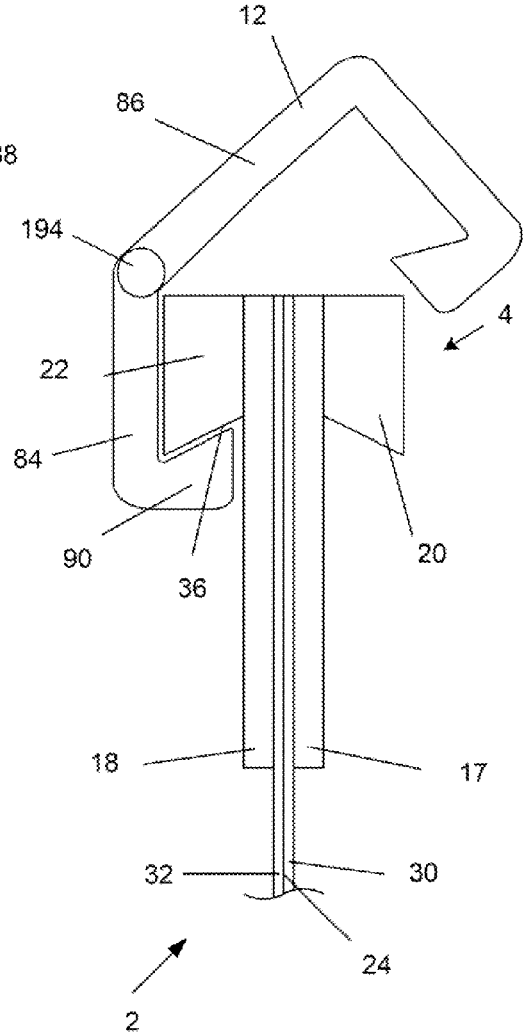

FIG. 12 illustrates that the slider 12 can have one or more rotatable elements, for example hinges or joints. The joint 194 can be at the intersection of the slider top 86 and the slider first 82 and/or second 84 side. The joint 194 can enable the slider top 86 to rotate with respect to the slider first 82 and/or second 84 side. The joint 194 can be fixable (e.g., lockable), for example when the slider top 86 is at a right angle with respect to the slider first 82 and/or second 84 side. The joint 194 can be passive and/or biased to force the slider top 86 to a right angle with respect to the slider first 82 and/or second 84 side.

Figure 13:
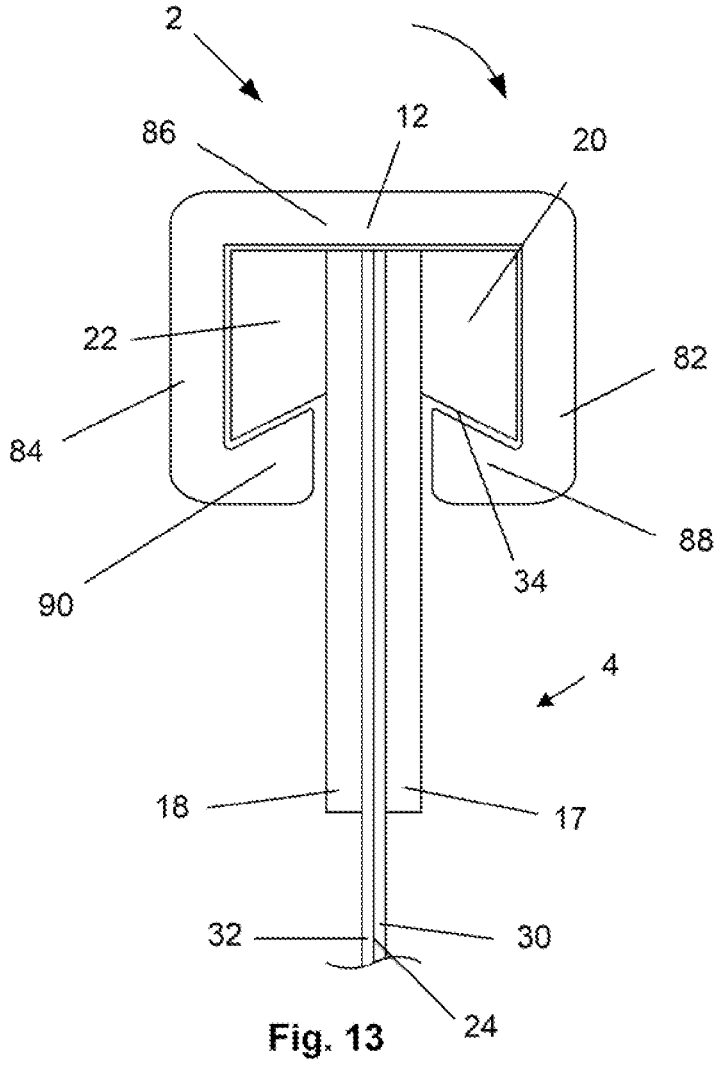
FIG. 13 illustrates an embodiment of the reservoir system with the slider attached to the bag.

FIG. 13 illustrates that the slider 12 of FIGS. 11 and 12 can be released and/or forcibly rotated, as shown by arrow. The slider first arm 88 can snap onto the first catch 20, fixedly attaching to the first catch bottom 34 and/or producing the arm compression force 190. The slider first side 82 can be directly adjacent to the first catch and/or producing the side compression force 192.

Figure 14:
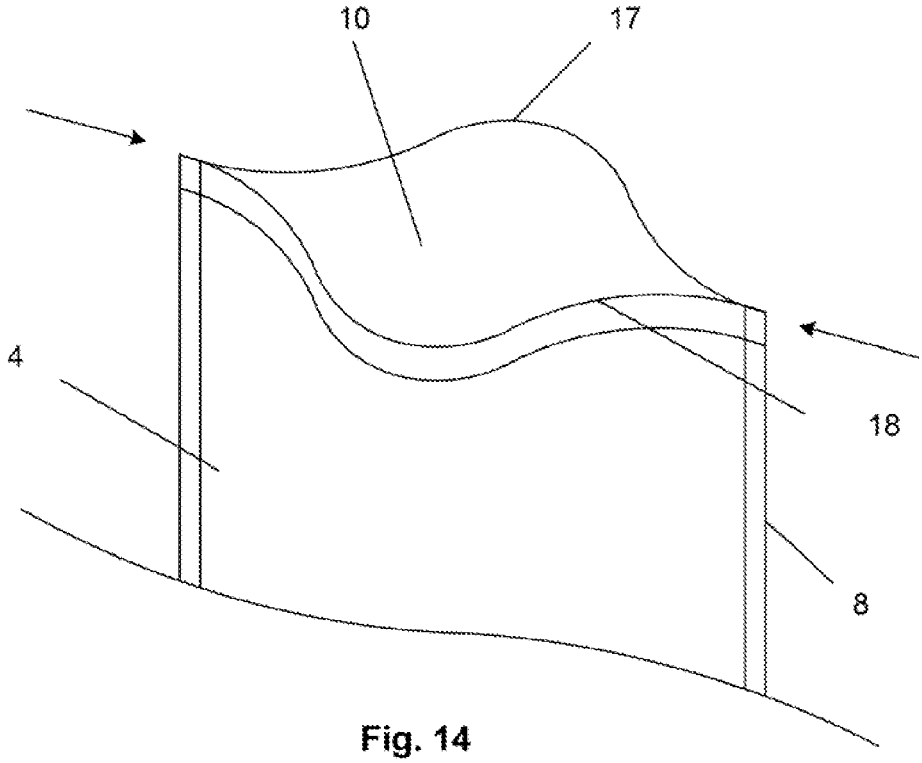
FIG. 14 is a perspective view of an embodiment of a method of using the bag.

FIG. 14 illustrates that the orifice 10 can be opened when the slider 12 is not engaged to seal the orifice 10. Compressive forces, as shown by arrows, can be applied to the ends of the lips 17, 18. Tensile forces, not shown (but perpendicular to the shown compressive forces), can be applied to the sides of the lips 17, 18. The first lip 17 can separate from the second lip 18. The lips 17, 18 can open in a puckered configuration. During use, solids and/or fluids (e.g., potable water, other beverages) can be transferred into and/or out of the bag 4 from the open orifice 10. The flexible bag 4 can be turned inside out through the orifice 10, for example, to aid access and cleaning the inside of the bag 4. The lips 17, 18 can be configured to be resiliently biased to close.

The slider 12 can be attached to the bag 4. For example, a leash can attach the slider 12 to the bag 4. The leash can be attached to the first and/or second hole. Also for example, the slider 12 and/or bag 4 can have a catch configured so the slider 12 can not be completely slidably removed from the bag 4.

It is apparent to one skilled in the art that various changes and modifications can be made to this disclosure, and equivalents employed, without departing from the spirit and scope of the invention. Elements of systems, devices and methods shown with any embodiment are exemplary for the specific embodiment and can be used in combination or otherwise on other embodiments within this disclosure.

We claim:

1. A reservoir closure system comprising:

a container wherein the container comprises a first end, the first end having a first lip, a first catch, a second lip, a second catch, a reservoir and an orifice at the first end having a closed configuration and an opened configuration, and wherein the container is sufficiently flexible to be turned inside out and wherein the reservoir is in fluid communication with the orifice, and wherein the orifice has an orifice closed length about the width of the first end of the container when the orifice is in the closed configuration;

a sealing member configured to slidably attach to the container, and wherein the sealing member has a seal length, and wherein the seal length is at least substantially equal to the orifice closed length, and wherein the sealing member is configured to seal the container, and wherein the sealing member has a substantially straight configuration;

wherein the sealing member comprises a channel defined by a sealing member first side, a sealing member second side, and a first upper arm and a first tower arm extending from the sealing member first side and positioned opposite a second upper arm and a second lower arm extending from the sealing member second side; and wherein the sealing member first side is rigidly integral with the sealing member second side; and wherein the sealing member has a sealing member longitudinal axis, a seating member first end and a sealing member second end, and wherein the shape of the sealing member first end radially expands away from the sealing member longitudinal axis as the length along the sealing member first end approaches the terminus of the sealing member; and wherein the sealing member first side is at a fixed width away from the sealing member second side when the system is in a first configuration when the sealing member is separate from the container and when the system is in a second configuration when the sealing member is attached to the container and induces sealing of the container; and wherein the channel is configured to receive the first and second catches of the container as the sealing member is slidably attached to the container such that the first and second upper arms compress the first and second lips above the received first and second catches, the first and second lower arms compress the first and second lips below the received first and second catches to seal the container, and the first and second catches prevent substantial movement of the sealing member in a vertical direction relative to the container.

2. The system of claim 1, wherein the first catch has a first catch bottom, and wherein the first catch bottom has a first catch angle, and wherein the first catch angle is less than about 90 degrees.

3. The system of claim 2, wherein the sealing member has a first lower arm angle defined between the sealing member first side and the first lower arm.

4. The system of claim 3, wherein the first catch angle is substantially equal to the first lower arm angle.

5. The system of claim 3, wherein the sealing member is configured to be interference fit to the container.

6. The system of claim 1, wherein the container comprises a polyurethane.

7. The system of claim 6, wherein the polyurethane comprises TPU.

8. A method of closing the reservoir system of claim 1, comprising pressing the first lip and the second lip together above and below the first and second catches along the entire closed orifice length with the sealing member; and securing the sealing member to the container; wherein securing comprises attaching the sealing member to the first and second catches.

9. The method of claim 8, wherein pressing comprises sliding the sealing member onto the container.

10. A reservoir closure system comprising:

a container wherein the container comprises a first end, the first end having a first lip, a second lip positioned opposite the first lip, a first catch, a second catch, a reservoir and an orifice, wherein the reservoir is in fluid communication with the orifice, and wherein the container is sufficiently flexible to be turned inside out;

a sealing member configured to slidably attach to the container wherein the sealing member comprises a channel defined by a sealing member first side, a sealing member second side, and a first upper arm and a first lower arm extending from the sealing member first side and positioned opposite a second upper arm and a second lower arm extending from the sealing member second side;

wherein the sealing member first side is rigidly integral with the sealing member second side; and wherein the sealing member has a sealing member longitudinal axis, a sealing member first end and a sealing member second end and wherein the shape of the sealing member first end radially expands away from the sealing member longitudinal axis as the length along the sealing member first end approaches the terminus of the sealing member; and wherein the sealing member first side is at a fixed width away from the sealing member second side when the system is in a first configuration when the sealing member is separate from the container and when the system is in a second configuration when the sealing member is attached to the container and induces sealing of the container; and wherein the channel is configured to receive the first and second catches of the container as the sealing member is slidably attached to the container such that the first and second upper arms compress the first and second lips above the received first and second catches, the first and second lower arms coin press the first and second lips below the received first and second catches to seal the container, and the first and second catches prevent substantial movement of the sealing member in a vertical direction relative to the container, wherein the container comprises a polyurethane.

11. The system of claim 10, wherein the polyurethane comprises TPU.

12. The system of claim 10, further comprising a leash attached to the sealing member and attached to an element of the system other than the sealing member.

13. A reservoir closure system comprising;

a bag comprising a first bag wall, a second bag wall and an orifice between the first and second bag walls;

a first catch on the first bag wall, wherein the first catch faces away from the orifice and is positioned on a first lip;

a second catch, wherein the second catch faces away from the orfice, wherein when the bag is in a closed configuration, the first catch faces in an opposite direction to the second catch;

a sealing member configured to slidably attach to the bag, wherein the sealing member comprises a channel defined by a sealing member first side, a sealing member second side, and a first upper arm and a first lower arm extending from the sealing member first side and positioned opposite a second upper arm and a second lower arm extending from the sealing member second side; and wherein the sealing member first side is rigidly integral with the sealing member second side; and wherein the channel is configured to receive the first and second catches of the bag as the sealing member is slidably attached to the bag such that the first and second upper arms compress the first and second lips above the received first and second catches, the first and second lower arms compress the first and second lips below the received first and second catches to seal the bag, and the first and second catches prevent substantial movement of the sealing member in a vertical direction relative to the bag; and wherein the sealing member has a sealing member longitudinal axis, a sealing member first end and a sealing member second end, and wherein the shape of the sealing member first end radial expands away from the sealing member longitudinal axis as the length along the sealing member first end approaches the terminus of the sealing member; and wherein a first length along the sealing member first side is at a channel width away from a first length along the sealing member second side when the system is in a first configuration when the sealing member is separate from the container and when the system is in a second configuration when the sealing member is attached to the container and induces sealing of the container.

14. The system of claim 13, comprising no catches on an inside surface of the first or second bag walls.

* * * * *